US010166695B1

(12) United States Patent
Stachowski

(10) Patent No.: US 10,166,695 B1
(45) Date of Patent: Jan. 1, 2019

(54) PROCESS FOR SPLITTING A SEGMENT OF WOOD

(76) Inventor: Paul W. Stachowski, Grand Haven, MI (US)

( * ) Notice: Subject to any disclaimer, the term of this patent is extended or adjusted under 35 U.S.C. 154(b) by 23 days.

(21) Appl. No.: 12/660,789

(22) Filed: Mar. 4, 2010

Related U.S. Application Data

(60) Provisional application No. 61/163,890, filed on Mar. 27, 2009.

(51) Int. Cl.
*B27L 7/00* (2006.01)

(52) U.S. Cl.
CPC ..... *B27L 7/00* (2013.01)

(58) Field of Classification Search
CPC ..... B27L 7/00; B27L 7/08; B27L 7/06
USPC ..... 144/193.1, 193.2, 195.8, 195.1, 195.7, 144/195.6, 4.6; 269/900, 266, 53, 54.2, 269/54.3, 54.4, 54.5
See application file for complete search history.

(56) References Cited

U.S. PATENT DOCUMENTS 4,102,373 A * 7/1978 Winiasz ..... 144/195.1
4,275,779 A * 6/1981 Rowe ..... 144/195.1
4,300,605 A * 11/1981 Pierrat ..... 144/195.1
4,303,233 A * 12/1981 Meyer, III ..... 269/54.5
4,782,868 A * 11/1988 Coller et al. ..... 144/195.1
4,782,870 A * 11/1988 Duerr ..... 144/195.1
7,011,123 B2 * 3/2006 Peterson ..... 144/195.1
7,159,627 B2 * 1/2007 St-Germain et al. ..... 144/195.5
7,556,072 B2 * 7/2009 Koch, Jr. ..... 144/366
2006/0260717 A1 11/2006 Bowers

FOREIGN PATENT DOCUMENTS

CN 202498603 U * 10/2012

OTHER PUBLICATIONS

LuCong, Vertical Electric Log Splitter webpage.*
Binderberger Maschinenbau GmbH, Binderberger—Upright Wood Splitter, Mar. 3, 2008, https://www.youtubel.com/watch?v=QWOyK8wTdgo.*
Steven Chappell, Hydraulic Log Splitter, Feb. 19, 2009, https://www.youtube.com/watch?v=QWOyK8wTdgo.*

* cited by examiner

*Primary Examiner* — Matthew Katcoff
(74) *Attorney, Agent, or Firm* — King & Partners, PLC

(57) ABSTRACT

A wood supporting apparatus for use with a wood splitting device having a splitting wedge which translates along a substantially vertical splitting axis for dividing a segment of wood into separate segments, the wood supporting apparatus having a base member with a vertical support member for supporting and rotatably positioning the segment of wood.

1 Claim, 5 Drawing Sheets

PROCESS FOR SPLITTING A SEGMENT OF WOOD

CROSS-REFERENCE TO RELATED APPLICATION(S)

This application claims the benefit of U.S. Provisional Application Ser. No. 61/163,890, filed Mar. 27, 2009—which is hereby incorporated herein by reference in its entirety.

BACKGROUND OF THE INVENTION

1. Field of the Invention

The present invention relates in general to a wood supporting apparatus and, more particularly, but not by way of limitation, to a wood supporting apparatus for use with a wood splitting device, which allows for the division of large segments of wood into smaller segments of wood in a fast, safe, and efficient manner.

2. Background Art

The use of wood splitting devices, such as conventional vertical log splitters is well known in the art. Although, the use of wood splitting devices is well known, issues relative to wood splitting speed, safety, and efficiency remain largely problematic. By way of background, conventional vertical log splitters comprise a support frame member which engages the ground, as well as a vertical support member that normally includes a vertically translating splitting wedge for dividing entire wood logs or segments of wood into separate and/or smaller segments of wood. In many cases, the splitting wedge of the wood splitting device is power operated in a manner such that the vertical movement of the splitting wedge along the vertical support is facilitated by, for example, a hydraulic cylinder.

As is best shown in FIG. 1, normally an entire wood log and/or segment of wood is placed below the splitting wedge of the wood splitting device without any positional and/or rotational assistance for the user. It will be understood that positioning and/or rotating the entire wood log or segment of wood can be extremely time consuming, and/or hard on the user's body, especially the user's back, feet, and/or hands, due to, among other things, the size and/or weight of the entire wood log or segment of wood, and/or the type of ground proximate the wood splitting device, etcetera. Once the entire wood log or segment of wood is in position, the splitting wedge is translated downwardly until it impacts the wood, dividing it into separate and/or smaller segments of wood. Typically, the divided segments of wood must be repositioned and/or rotated below the splitting wedge of the wood splitting device to further divide the segments of wood. To the best of Applicant's knowledge, this normally occurs without any positional and/or rotational assistance for the user. As such, repositioning and/or rotating the segments of wood are often time consuming, dangerous, and difficult because even the divided segments of wood can be extremely large and/or heavy to the user. Indeed, it is common for the user to bend over, pick up, position, and rotate these segments of wood each time the wood is further divided. Thus, the process is extremely time consuming and the user is at significant risk of injury to not only their spine and/or back, but also to their hands and/or feet as impingement between or under heavy segments of wood can frequently occur.

Thus the need exists for a wood supporting apparatus that assists a user in positioning and/or rotating a segment of wood above the ground, thereby increasing wood splitting speed, safety, and/or efficiency.

It is one object of the present invention to provide a wood supporting apparatus, which controllably assists the user in positioning and/or repositioning a log and/or segments of wood for splitting.

It is a further object of the present invention to provide a wood supporting apparatus, which substantially decreases the time required to split one or more logs and/or segments of wood.

These and other objects of the present invention will become apparent in light of the present specification, claims, and drawings.

SUMMARY OF THE INVENTION

The present invention is directed to a wood supporting apparatus for use with a wood splitting device having a splitting wedge which translates along a substantially vertical splitting axis for dividing a segment of wood into separate segments, the wood supporting apparatus comprising: (a) a base member, wherein the base member includes an upper surface and a lower surface, and further wherein the base member is positionable at least partially below the splitting wedge of the wood splitting device; (b) a vertical support member, wherein the vertical support member extends upwardly from the base member for rotatably supporting the segment of wood in such a way that the segment of wood may be rotated near or about its center of gravity; and (c) wherein a segment of wood is divisible into separate segments by placing the segment of wood onto the vertical support member and rotating the segment of wood prior to or while the splitting wedge reciprocates along the vertical splitting axis to divide the segment of wood into separate segments.

In a preferred embodiment of the present invention, the upper surface and the lower surface of the base member are planar and/or parallel to one another, excluding therefrom the vertical support member.

In another preferred embodiment of the present invention, the lower surface of the base member comprises a ground-engaging cleat, which substantially precludes rotation of the wood supporting apparatus during normal use of the same.

In yet another preferred embodiment of the present invention, the base member engages the ground and/or a lower portion of the wood splitting device during normal operation of the same.

In another aspect of the present invention, the vertical support member comprises a tubular, cylindrical, frusto-cylindrical, conical, frusto-conical, pyramidal, and/or frusto-pyramidal tip.

In yet another aspect of the present invention, the vertical support member comprises a substantially cylindrical tip having a planar upper surface, which is parallel to a planar upper surface of the base member.

The present invention is also directed to a wood splitting device in combination with a wood supporting apparatus, the wood supporting apparatus having a base member, wherein the base member includes an upper surface and a lower surface, and a vertical support member, wherein the vertical support member extends upwardly from the upper surface of the base member for rotatably supporting a segment of wood, the wood splitting device comprising: (a) a frame member comprising a vertical support disposed generally perpendicularly to the ground; (b) a power-operated reciprocating arm connected to the frame member; (c) a splitting wedge connected to the power-operated reciprocating arm, the splitting wedge translatable along a substantially vertical splitting axis; (d) wherein the wood supporting apparatus is positioned below the splitting wedge of the wood splitting device; and (e) wherein a segment of wood is divisible into separate segments by placing the segment of wood onto the vertical support member and rotating the segment of wood prior to or while the splitting wedge reciprocates along the substantially vertical splitting axis to divide the segment of wood into separate segments.

The present invention is further directed to a process for splitting a segment of wood, comprising the steps of: (a) providing a wood splitting device and a wood supporting apparatus as provided herein; (b) placing a segment of wood onto the vertical support member of the wood supporting apparatus; (c) rotating the segment of wood to a first position; (d) splitting the segment of wood into two segments with the splitting wedge of the wood splitting device; (e) placing one of the two split segments of wood onto the vertical support member of the wood supporting apparatus; (f) rotating the split segment of wood to a second position; and (g) splitting the previously split segment of wood into two segments with the splitting wedge of the wood splitting device.

The present invention is also directed to a wood supporting apparatus comprising: a vertical support member having a base member integrated therein, wherein the vertical support member extends upwardly from the ground for rotatably supporting a segment of wood, wherein the segment of wood is divisible into separate segments by placing the segment of wood onto the vertical support member and rotating the segment of wood prior to or while a splitting wedge reciprocates along a substantially vertical splitting axis to divide the segment of wood into separate segments.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted. It will be understood that the invention is not necessarily limited to the particular embodiments illustrated herein.

The invention will now be described with reference to the drawings wherein.

DETAILED DESCRIPTION OF THE INVENTION

Figure 1:
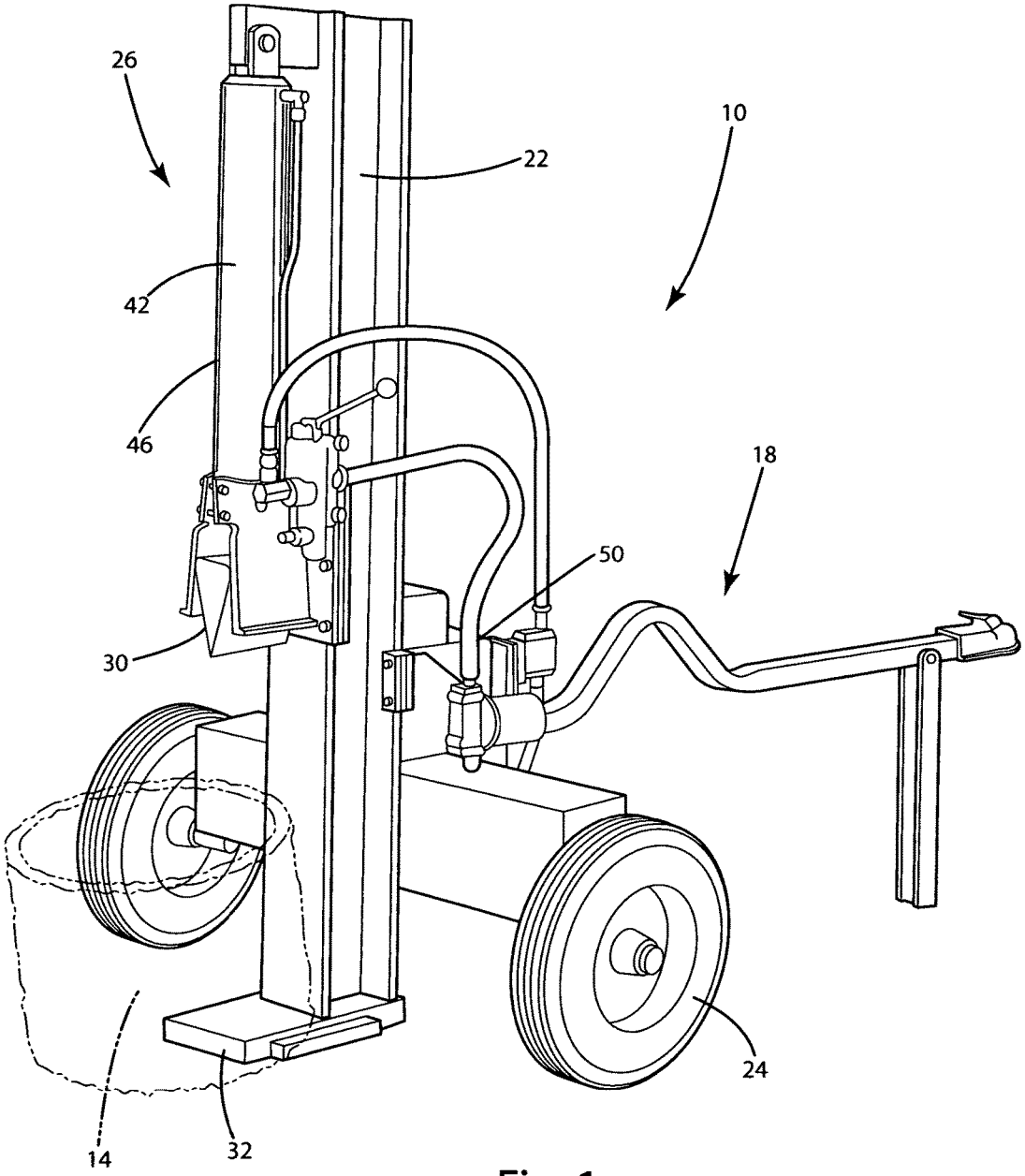
Fig. 1 Prior Art
FIG. 1 of the drawings is a perspective view of an entire wood log (sometimes referred to herein as a segment of wood) positioned below a splitting wedge of a wood splitting device without a wood supporting apparatus of the present invention.

While this invention is susceptible of embodiment in many different forms, there is shown in the drawings and will herein be described in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings and, more particularly, to FIG. 1, conventional wood splitting device 10 is shown associated with an entire wood log/segment of wood 14. Wood splitting device 10 generally comprises frame member 18 having vertical support member 22 disposed generally perpendicularly to the ground, and power-operated reciprocating arm 26 having splitting wedge 30.

Frame member 18 is preferably fabricated from a strong and rigid material, for example, metal or any other suitable material that would be known to one of ordinary skill in the art with the present disclosure before them. In one embodiment, frame member 18 is shown as a rectangle constructed from square tubular steel. Frame member 18 may optionally include two or more ground engaging wheels 24 for translating wood splitting device 10 along the ground. Vertical support member 22 is connected to frame member 18 and is preferably constructed of the same material as frame member 18. In one embodiment, vertical support member 22 comprises an I-beam extending vertically from frame member 18 and preferably includes ground engaging support foot 32 for stabilizing vertical support member 22 and/or segment of wood 14.

Figure 6A:
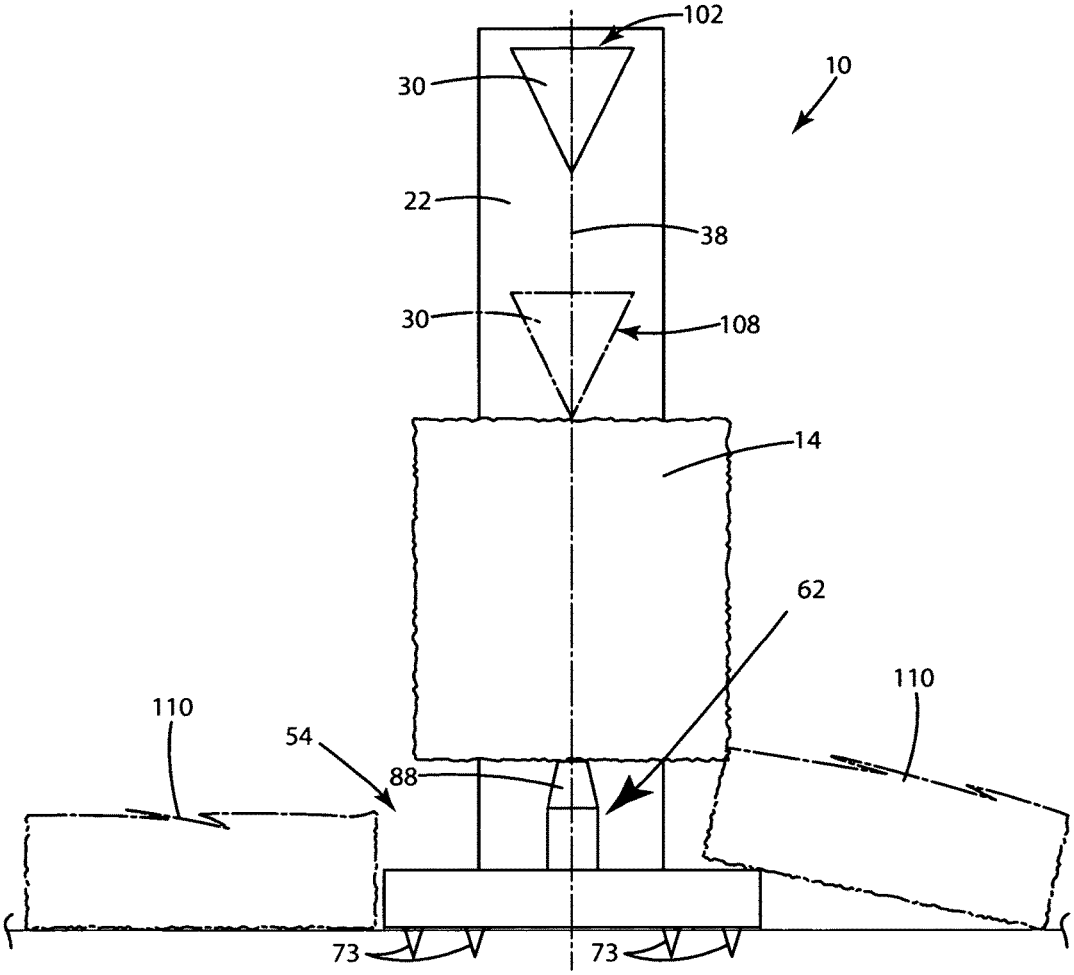
FIG. 6A of the drawings is a side elevational view of a portion of the wood splitting device of FIG. 2 and the wood supporting apparatus of FIG. 3 in association with a segment of wood.

Power-operated reciprocating arm 26 preferably includes any assembly that can cause splitting wedge 30 to translate upwardly and downwardly along substantially vertical splitting axis 38 (see FIG. 6A). By way of a non-limiting example, power-operated reciprocating arm 26 may include hydraulic cylinder 42 operatively connected to splitting wedge 30. Hydraulic cylinder 42 includes a barrel 46, piston (not shown) and hydraulic reservoir 50. Generally, the piston selectively reciprocates in and out of barrel 46 as hydraulic fluid is pumped into and out of barrel 46 from hydraulic reservoir 50. Hydraulic cylinder 42 is powered by, for example, an internal combustion engine (not shown), although other types of power plants that would be known to one of ordinary skill in the art with the present disclosure before them are likewise contemplated for use in accordance with the present invention. Splitting wedge 30 is connected to the piston of hydraulic cylinder 42 in a manner such that as the piston selectively reciprocates within barrel 46, splitting wedge 30 translates upwardly and downwardly along substantially vertical splitting axis 38 (see FIG. 6A).

It will be understood that while the wood splitting device has been disclosed as including wood splitting device 10, any other wood splitting device that would be known to one of ordinary skill in the art with the present disclosure before them are likewise contemplated for use in accordance with the present invention.

Figure 2:
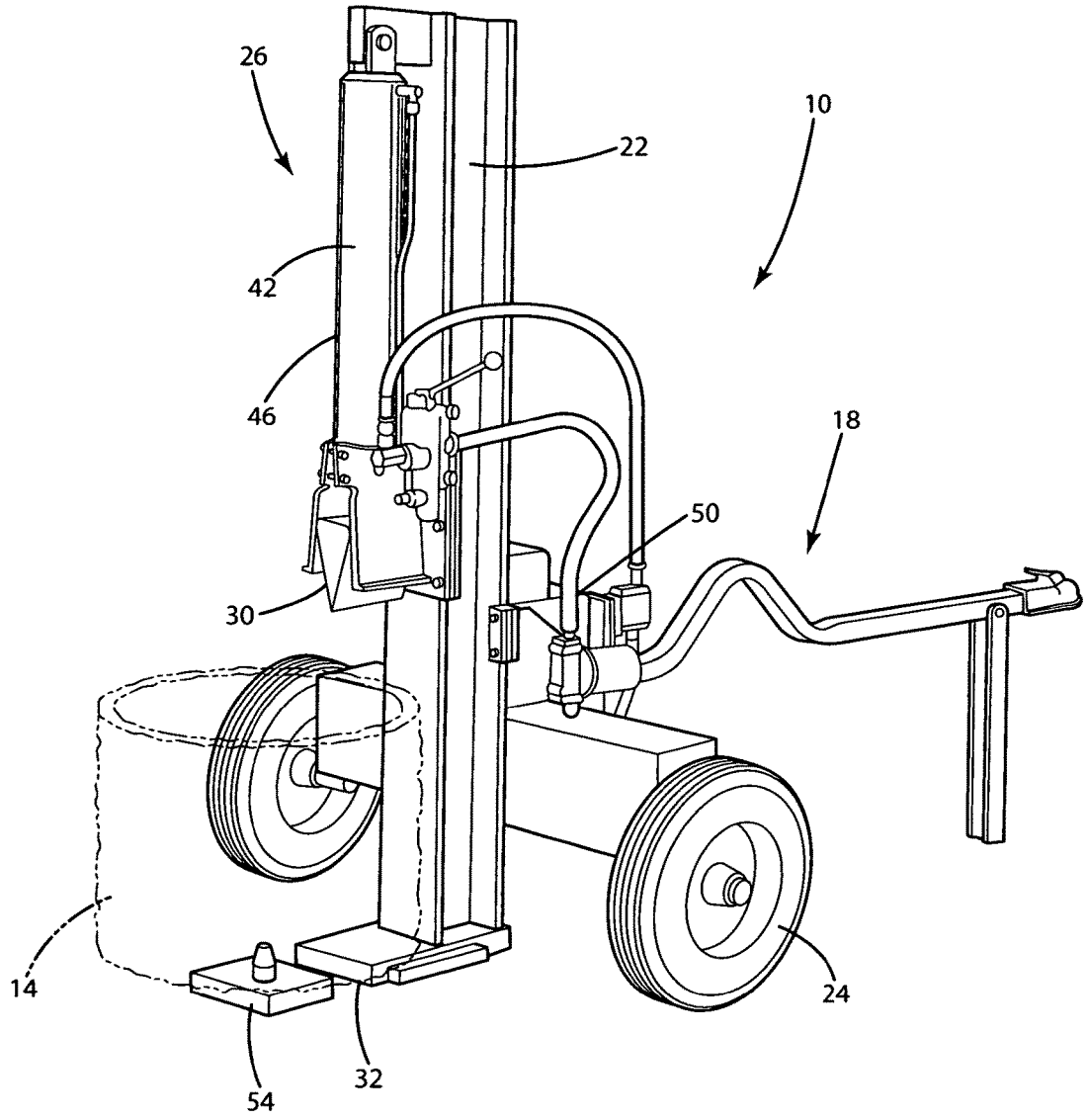
FIG. 2 of the drawings is a perspective view of an entire wood log positioned below a splitting wedge of a wood splitting device positioned on a wood supporting apparatus of the present invention.
Figure 3:
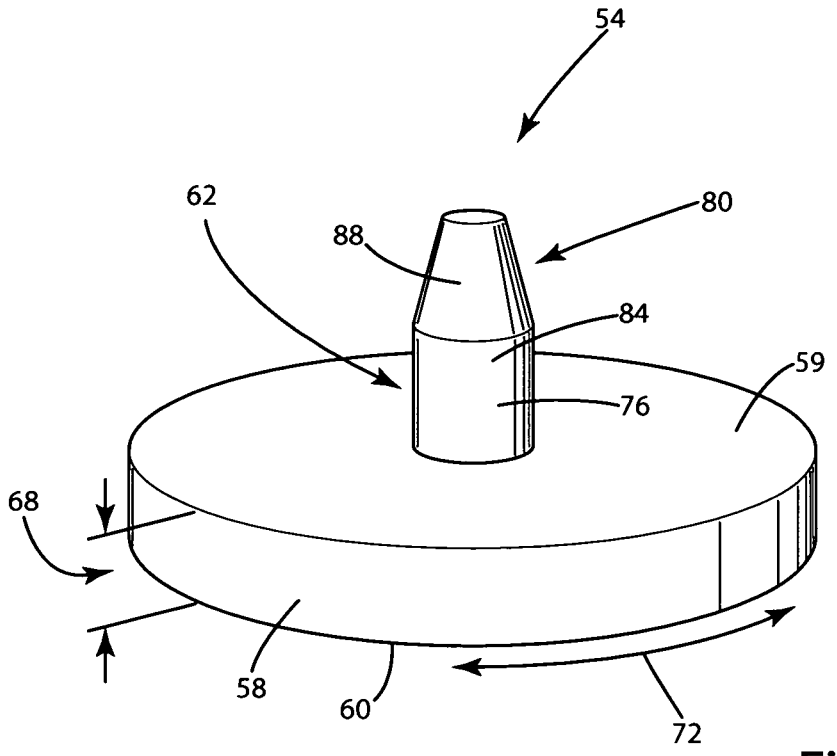
FIG. 3 of the drawings is a perspective view of a wood supporting apparatus for use in accordance with the present invention.
Figure 4:
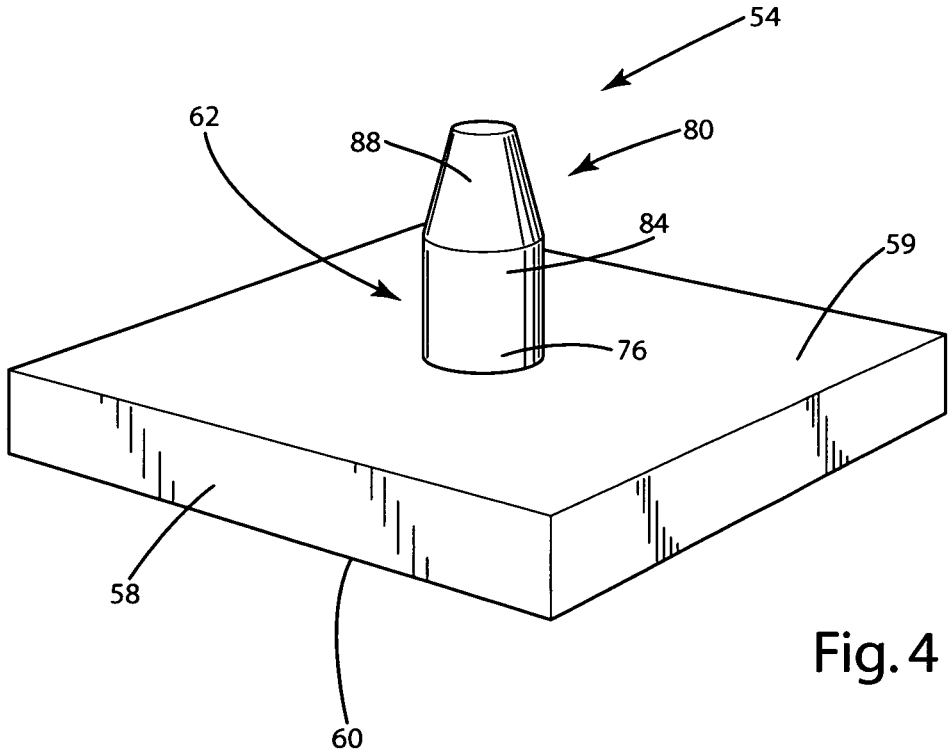
FIG. 4 of the drawings is a perspective view of a wood supporting apparatus for use in accordance with the present invention.
Figure 5A:
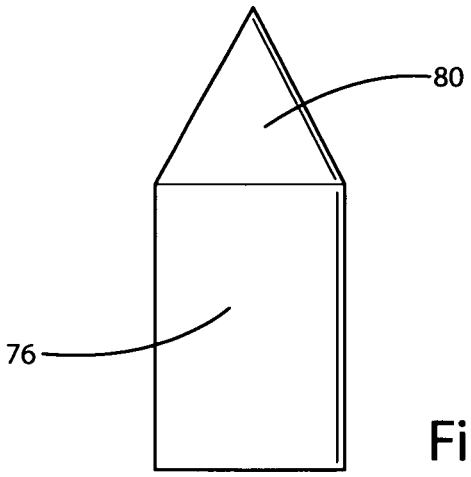
FIG. 5A of the drawings is a side elevational view of a tip of a wood supporting apparatus for use in accordance with the present invention.
Figure 5B:
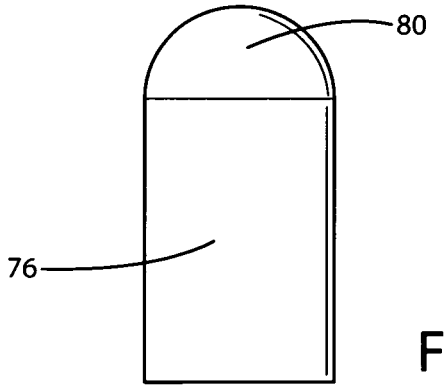
FIG. 5B of the drawings is a side elevational view of an alternative embodiment of a tip of a wood supporting apparatus for use in accordance with the present invention.
Figure 5C:
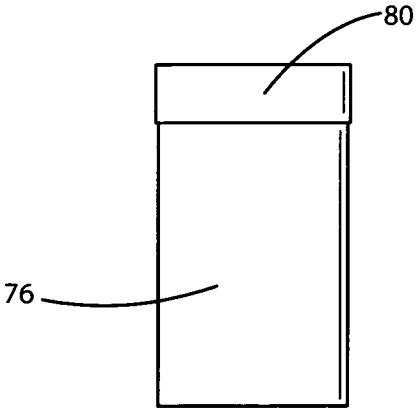
FIG. 5C of the drawings is a side elevational view of an alternative embodiment of a tip of a wood supporting apparatus for use in accordance with the present invention.

Referring now to FIG. 2, wood supporting apparatus 54 is shown in association with wood splitting device 10 and segment of wood 14. As is best shown in FIGS. 3 and 4, wood supporting apparatus 54 is shown as generally comprising base member 58 having upper surface 59 and lower surface 60, and vertical support member 62. Base member 58 may optionally include one or more cleats 73 (FIG. 6A). Base member 58 and vertical support member 62 may be integrally fabricated into a monolithic piece or, alternatively, they may be fabricated as separate components such that vertical support member 62 may be replaced for maintenance and/or other purposes. Base member 58 is preferably constructed from a strong and rigid material, for example, a metal, a natural and/or synthetic plastic, etcetera—although any number of other materials that would be known to one of ordinary skill in the art with the present disclosure before them are likewise contemplated for use in accordance with the present invention. Base member 58 is shown in FIG. 3 comprising a cylindrical disk having height 68 and circumference 72. Height 68 and circumference 72 of the cylindrical disk will vary according to design requirements. It will be understood that although base member 58 has been disclosed as having the shape of a cylindrical disk, base member 58 may be constructed having any number of different shapes, for example, square, rectangular (see FIG. 4), triangular, elliptical, polygonal, irregular and the like. It will be further understood that base member 58 may comprise dimensions that are the same or similar to vertical support member 62 such that wood supporting apparatus 54 appears to be void of base member 58, and comprise only vertical support member 62. For example, as is shown in FIGS. 5A-5C, among others, the wood supporting apparatus may comprise a base member with the same dimensions as a vertical support member and, in turn, appear to be and/or are one in the same.

Vertical support member 62 is shown as having body 76 preferably extending upwardly from base member 58. Vertical support member 62 also preferably includes tip 80 disposed at terminal end 84 of body 76. Tip 80 may include, for example, frusto-conical tip 88 adapted to receive at least a portion of a segment of wood as will be discussed in greater detail below. Other preferred embodiments of tip 80 include, for example, a substantially conical tip (FIG. 5A), a substantially rounded tip (FIG. 5B) and substantially blunted tip (FIG. 5C). It will be understood that the tip 80 of the vertical support member 62 may be fabricated in such a way that the tip 80 is interchangeable, or alternatively the tip 80 may be formed integrally with the body 76. It will be understood that vertical support member 62 may also be fabricated without body 76, wherein tip 80 is directly associated with upper surface 59 of base member 58.

Referring now to FIG. 6A, in operation, wood supporting apparatus 54 having frusto-conical tip 88 is preferably placed below splitting wedge 30 of wood splitting device 10. Splitting wedge 30 is shown in an initial or raised position 102. It will be understood that in some applications, wood supporting apparatus 54 may be placed upon and/or integrated with ground engaging support foot 32 (FIGS. 1, 2) of vertical support 22. In another embodiment, wood supporting apparatus 54 is placed directly on the ground. Nevertheless, wood supporting apparatus 54 is preferably positioned such that vertical support member 62 of wood supporting apparatus 54 is substantially proximate the substantially vertical splitting axis 38 of wood splitting device 10.

Wood segment 14 is placed onto frusto-conical tip 88 of wood supporting apparatus 54 such that wood segment 14 and frusto-conical tip 88 are substantially in axial alignment. Wood segment 14 may be freely rotated about frusto-conical tip 88 for precision splitting of wood segment. Next, splitting wedge 30 of wood splitting device 10 is translated downwardly until it impacts wood segment 14, thereby dividing wood segment 14 into two halves 110. After dividing wood segment 14, splitting wedge 30 is preferably in a final (not shown) or lowered position 108. To prepare to further divide two halves 110, splitting wedge 30 is moved to initial position 102 again.

Figure 6B:
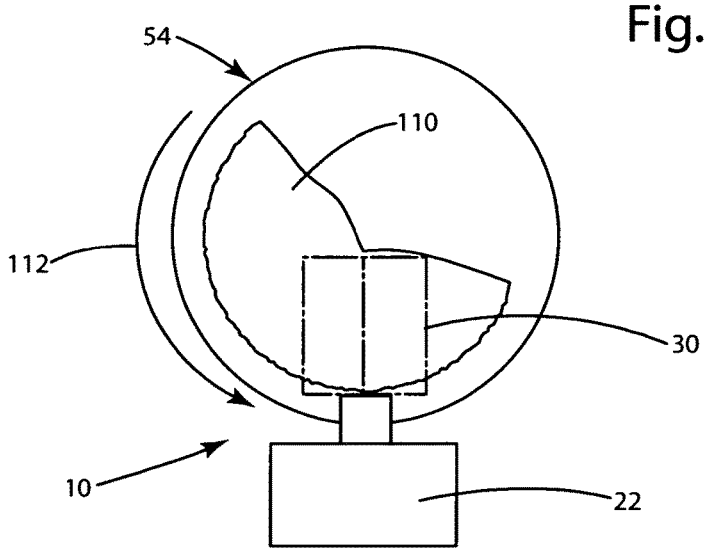
FIG. 6B of the drawings is a top plan view of a portion of the wood splitting device of FIG. 2 and the wood supporting apparatus of FIG. 3 in association with a divided segment of wood.

Referring now to FIG. 6B, further division of two halves 110 is performed by placing one of the two halves 110 onto frusto-conical tip 88 of wood supporting apparatus 54 for further precision splitting of the wood segment. Splitting wedge 30 of wood splitting device 10 is translated downwardly until it impacts the half 110 shearing off a segment of wood having a preferred size (not shown). Splitting wedge 30 is translated to initial position 102 and half 110 is then rotated, as illustrated by directional arrow 112, on frusto-conical tip 88 about vertical splitting axis 38. Splitting wedge 30 of wood splitting device 10 is again translated downwardly until it impacts the half 110 shearing off another segment of wood having a preferred size. The steps of rotating and splitting of half 110 is continued until half 110 has been separated into segments of wood having a preferred size (not shown). The steps of rotating and splitting are preformed on the second of halves 110, dividing it into segments of wood having a preferred size.

It will be understood that wood supporting apparatus 54 facilitates the splitting of an entire wood log and/or previously split segment of wood in a faster, safer, and more efficient manner compared to splitting an entire wood log and/or previously split segment of wood without the wood supporting apparatus.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A process for splitting a segment of wood, consisting of the steps of:

providing a wood supporting apparatus, wherein the wood supporting apparatus consists of a base member and a vertical support member, wherein the base member includes an upper surface and a bottom surface, wherein the upper surface is planar, wherein the bottom surface is planar, wherein the base member includes a square outer peripheral geometry, wherein the vertical support member is being positioned in alignment with a central axis of the base member, wherein the vertical support member extends upwardly from the upper surface of the base member for rotatably supporting a segment of wood, wherein the vertical support member consists of a cylindrical portion and an upper a frusto-conical portion, wherein the frusto-conical portion is positioned above the cylindrical portion, wherein the frusto-conical portion terminates with a planar top that rotatably supports the segment of wood in a spaced apart relationship from the upper surface of the base member, and wherein the planar top tip of the vertical support member, the upper surface of the base member, and the bottom surface of the base member are parallel to one another;

providing a wood splitting device, wherein the wood splitting device consists of a frame member having an I-beam vertical support disposed generally perpendicularly to the ground, a ground engaging support foot having a top surface positioned orthogonal to the I-beam vertical support, a power-operated reciprocating arm connected to the frame member, a splitting wedge connected to the power-operated reciprocating arm, wherein the splitting wedge is translatable along a substantially vertical splitting axis;

placing the bottom surface of the base member of the wood supporting apparatus onto the top surface of the ground engaging support foot;

placing a segment of wood onto the vertical support member of the wood supporting apparatus;

rotating the segment of wood about the vertical support member to a first position;

splitting the segment of wood into two segments with the splitting wedge of the wood splitting device;

placing one of the two split segments of wood onto the vertical support member of the wood supporting apparatus;

rotating the split segment of wood about the vertical support member to a second position; and splitting the previously split segment of wood into two segments with the splitting wedge of the wood splitting device.

* * * * *